US005515893A

United States Patent [19]

Donohue

[11] Patent Number: 5,515,893

[45] Date of Patent: May 14, 1996

[54] VAPOR RECOVERY BOOT RETAINER

[76] Inventor: Thomas E. Donohue, 2 Pondfield Rd., New Fairfield, Conn. 06812

[21] Appl. No.: 350,838

[22] Filed: Dec. 7, 1994

[51] Int. Cl.[6] ..... B65B 57/06

[52] U.S. Cl. ..... 141/392; 141/98; D8/349; D8/354; D15/9.1

[58] Field of Search ..... 141/1, 59, 98, 141/392; 251/90; 224/901; 248/205.2; D8/349, 354; D15/9.1

[56] References Cited

U.S. PATENT DOCUMENTS

| | | | |
|---|---|---|---|
| D. 345,687 | 4/1994 | Bagnes et al. | D8/349 |
| 3,759,423 | 9/1973 | Hansel | 141/392 X |
| 3,840,055 | 10/1974 | Wostl et al. | 141/44 |
| 3,866,636 | 2/1975 | Lasater | 141/59 |
| 4,671,528 | 6/1987 | Thompson | 280/504 |
| 4,751,923 | 6/1988 | Marino | 224/901 X |
| 4,804,025 | 2/1989 | Bear | 224/901 X |
| 5,104,169 | 4/1992 | Kopnski | 296/1.1 |
| 5,238,036 | 8/1993 | Bunce | 141/392 |
| 5,281,042 | 1/1994 | Belrose | 403/234 |
| 5,285,830 | 2/1994 | Hilpepre, Jr. | 141/312 |
| 5,320,148 | 6/1994 | Asciutto | 141/392 |

FOREIGN PATENT DOCUMENTS

WO88/03127 5/1988 Italy .

*Primary Examiner*—J. Casimer Jacyna
*Attorney, Agent, or Firm*—Richard C. Litman

[57] ABSTRACT

A splash control nozzle assembly for the dispensing of fluids includes a detachable tether assembly which forces back the resilient sealing bellows member on a gasoline pump nozzle to allow unobstructed viewing while filling unconventional receptacles to prevent overfilling. The tether main body is either a bungee cord or a strip of inelastic material with hook and loop fasteners at each end. An S-hook and snap clip are provided to secure the ends of the main body of the tether in place.

12 Claims, 2 Drawing Sheets

VAPOR RECOVERY BOOT RETAINER

BACKGROUND OF THE INVENTION

1. Field of the Invention

The present invention relates to a vapor boot tether for a vapor control assembly on a fuel nozzle to allow user viewing and better control against splashing and overfilling when filling unconventional receptacles.

2. Description of the Prior Art

Presently, gasoline pump nozzles must include a boot assembly in most jurisdictions which prevent excess evaporation of the gasoline and kerosene into the atmosphere. This boot assembly causes a problem with the filling of motorcycle gas tanks and gas cans because the boot must be retracted or held back manually in order to view the filling of these special receptacles.

A number of patents have been issued that address the problems of utilizing the vapor recovery apparatus of gas nozzles.

In U.S. Pat. No. 3,840,055 issued on Oct. 8, 1974 to Wolfgang J. Wostl et al. and U.S. Pat. No. 3,866,636 issued on Feb. 18, 1975 to Donald A. Lasater, a closure plug is positioned in front of the gas nozzle assembly to limit the gasoline vapor and liquid from splashing back out of the gasoline tank filler pipe of an automobile.

In U.S. Pat. No. 5,238,036 issued on Aug. 24, 1993 to Eugene B. Bunce, a gas nozzle adapter in the form of a sling shot is utilized with the addition of a circumferential protuberance on the gas nozzle tube in order to hold back the gas nozzle hose while the operator is filling gas cans, older automobiles and motorcycles. This enables the operator to dispense gasoline with one hand. The handle of the adapter may have a hole to enable the adapter to be suspended from a key chain or any other comparable carrying mechanism. However, there is neither a teaching nor a suggestion that (1) the adapter can be utilized without the circumferential protuberance permanently installed on the gas nozzle tube, and (2) the adapter can be tethered to another part of the gas nozzle assembly.

In U.S. Pat. No. 5,320,148 issued on Jun. 14, 1994 to Joseph Asciutto, a fuel nozzle retainer in the form of a perforated clip which is positioned on the gas nozzle tube by friction to hold back the bellows is disclosed. The clip may have various configurations, but again there is neither a teaching nor suggestion for a tethered arrangement.

In U.S. Pat. No. 5,285,830 issued to Lloyd C. Hilpipre, Jr. on Feb. 15, 1994, a motorcycle fuel tank extension adapter tube having a locking structure is disclosed.

Finally, in PCT WO 88/03127 published on May 5, 1988 for Alba Monica, a fuel dispensing spout attachment which permanently mounts on a gasoline nozzle is disclosed.

None of the above inventions and patents, taken either singly or in combination, is seen to describe the instant invention as claimed.

SUMMARY OF THE INVENTION

The present invention is a retractor which can be removably attached to a fuel pump nozzle to enable the operator to temporarily and effectively retract the vapor recovery boot in order to fill receptacles and fuel tanks of vehicles such as motorcycles and older automobiles other than modern automobiles and trucks equipped with vapor control inlet assemblies. The objective of this invention is to enable the operator to see the filling process in order to prevent splashing of the fuel due to over-filling.

Accordingly, it is a principal object of the invention to provide a vapor recovery boot retractor.

It is another object of the invention to provide a vapor recovery boot retractor which is removably attached to a fuel pump nozzle assembly by a tethered arrangement.

It is a further object of the invention to provide a vapor recovery boot retractor which allows the operator to view the quantity of fuel in a container being filled in order to prevent overfilling.

Still another object of the invention is to provide an operator with a retrofittable tethered retractor device for filling the fuel reservoirs of older automobiles and trucks as well as motorcycles and outboard motors in order to prevent over-filling.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to a vapor boot tether assembly for removable connection to a gasoline or other fuel pump nozzle assembly. The tether assembly enables the operator to hold back the bellows sealing member in order to periodically view the filling process and prevent overfilling of any receptacle not having a modern fuel receiver inlet.

Figure 1:
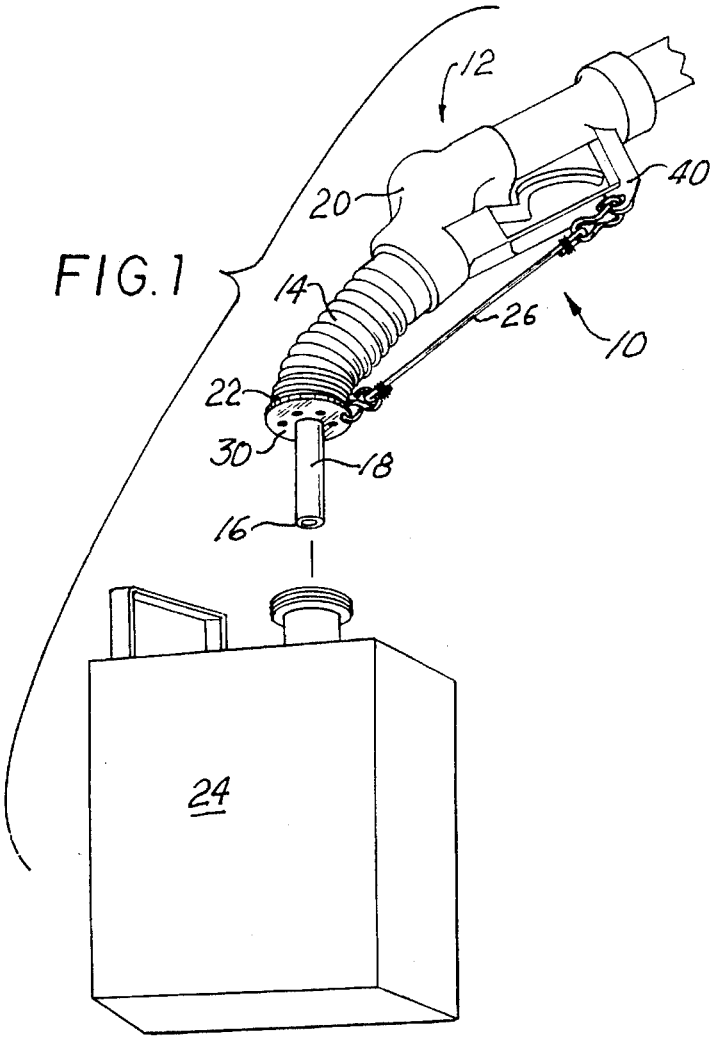
FIG. 1 is an environmental perspective view of a first embodiment of the tether assembly on a fuel pump nozzle assembly.
Figure 2:
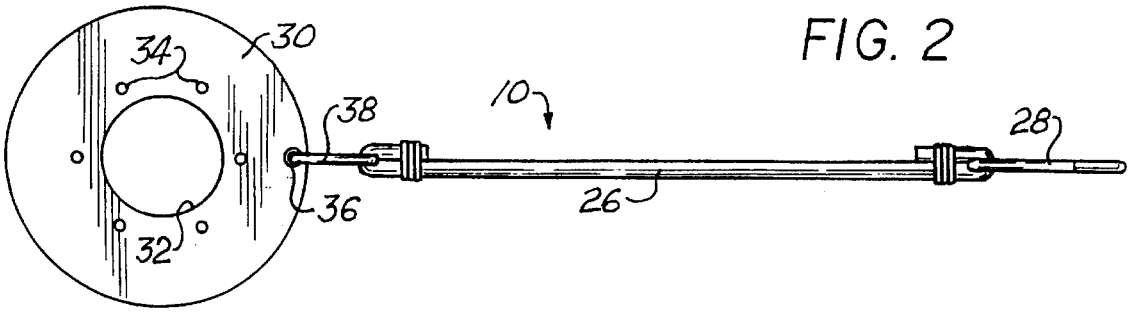
FIG. 2 is a top plan view of the first embodiment of the tether assembly shown in FIG. 1.
Figure 3:
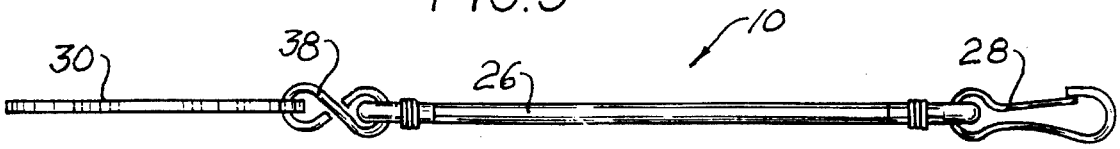
FIG. 3 is a side elevational view of the tether assembly seen in FIG. 2.

FIG. 1 illustrates the application of a first embodiment of the tether assembly 10 on a fuel pump nozzle assembly 12. Conventional fuel pumps now have an elongated and resilient bellows sealing member 14 juxtaposed with the distal nose 16 of the nozzle 18 which is attached to the body section 20. The displaceable end face 22 of the sealing member 14 must be forced back to at least a partially collapsed condition to expose more of the distal nose 16 of the nozzle 18 before the fuel will be permitted to flow out of the nozzle 18 and into a receptacle, which may be either a fuel can or container 24, or the fuel tank receiver inlet of a vehicle or the like.

Tether element 26 has a first portion attached to the body section 20 by an attachment means such as a snap hook 28 or the like. A second portion of the tether element 26 has a releasable attachment means positioned over the distal nose 16 and is releasably attachable to the bellows sealing member 14 by means of a circular plate 30 having a central aperture 32. Plate 30 has a plurality of fuel vapor recovery holes 34 bordering the periphery of the plate numbering preferably from 4 to 8. The number, size and location of the fuel vapor recovery holes 34 will vary in a manner to adequately allow proper vapor recovery during operation of the fuel pump nozzle assembly 12. The plate 30 also has an attachment hole 36 near an edge for releasable attachment of the tether element 26 by means of an S shaped hook 38. Although the plate 30 is depicted as being preferably circular, the shape can be altered to provide a tongue for the attachment aperture (not shown). This modification would minimize abrasion between the plate 30 and either S-hook 38 or snap hook 28 with the sealing member 14.

The tether element 26 defines a predetermined distance between the first and second portions, which is selected to retain the bellows sealing member 14 in at least a partially collapsed condition with the end face 22 displaced away from the distal nose 16 toward the body section 20. The opposite end of the tether element 26 has a snap hook 28 or the like which conveniently attaches releasably to a conventional aperture 40 in the body section 20.

The tether element 26 can be either a non-elastic element, a bungee cord or a rubber element. The bungee cord of the first embodiment being described, can be approximately 6 inches in length and ¼ inch in diameter. The plate 30 can have a shape other than circular with vapor recovery holes 34 of approximately ⅛ inch in diameter. Plate 30, S-hook 38, tether element 26, and snap hook 28 can be made of metal such as stainless steel or a fuel resistant plastic such as a tetrafluoroethylene polymer. The S-hook 38 can be approximately ½ inch in length. The snap hook 28 can be approximately 1¼ inches in length. S-hook 38 and snap hook 28 can be interchanged. These dimensions of the various parts are exemplary and result in the effective displacement of the end face 22 of the sealing member 14 to enable the operator to periodically view the filling operation.

In operation, the tether element 26 is affixed to the body section 20 by means of the snap hook 28. The plate 30 is slipped over the nozzle 18 and engages the end face 22 to expose more of the distal nose 16. If the tether element is non-elastic, the user or operator can slip the plate 30 first over the nozzle 18 before attaching the snap hook 28 to aperture 40 of the body portion 20.

The operator can now confidently fill the fuel container 24 with one hand without fear of overfilling and causing a splashing over of the volatile fuel. It should be noted that the plate 30 and the displaceable end face 22 of the sealing member 14 sealingly abut the open mouth of a receptacle, e.g., fuel can 24, to prevent excessive fuel vapors from escaping during the refueling process and only periodically is the visual observation of the filling process made by partially withdrawing the nozzle assembly. After filling the container 24, the plate 30 can be readily removed from the nozzle 18 by virtue of the elastic tether element 26 and retained in proximity of the nozzle 18.

Figure 4:
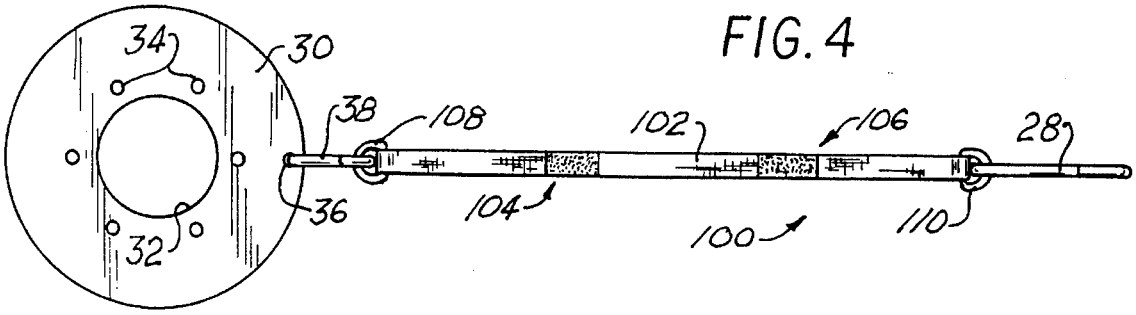
FIG. 4 is a top plan view, similar to FIG. 2, but showing a second embodiment of the tether assembly.
Figure 5:
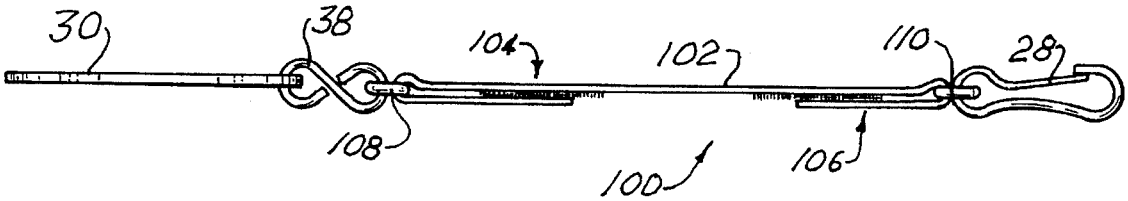
FIG. 5 is a side elevational view of the tether assembly seen in FIG. 4.
Figure 6:
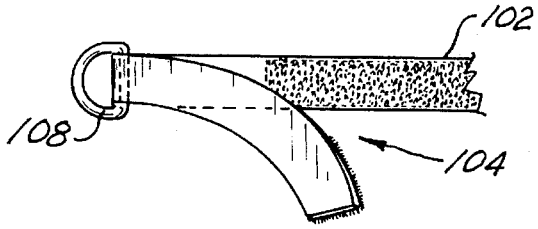
FIG. 6 is an enlarged scale, fragmentary elevational view showing one attachment end of the tether of the second embodiment.

A second embodiment of the invention is the tether assembly 100 illustrated in FIGS. 4–6. The construction and function of the plate 30, S-hook 38 and snap hook 28 are the same as in the first embodiment. However, the bungee cord of the first embodiment is replaced by an inelastic strip 102 provided at least at its end portions with hook and loop (e.g., VELCRO) fasteners 104, 106, which are looped through respective D rings or the like, 108, 110, secured in S-hook 38 and snap hook 28, respectively. In use, the strip 102 end fasteners 104,106 are adjusted appropriately so that the strip 102 has the correct length such that parts are disposed as seen in FIG. 1, with respect to the first embodiment. After a container or tank is filled, the snap hook 28 can be released to allow one to slip the plate 30 off the nozzle 18, and then reattached, or one of the fasteners 104, 106 might be detached to remove the plate 30 from nozzle 18, and then reattached so as to retain the tether assembly in proximity of the nozzle 18. Also, the snap hook 28 and D ring 110 assembly shown might be replaced by a single snap hook (not shown) having a wide band end configured to function the same as the D ring 110; such snap rings are common and available, and form no part of the instant invention per se. Furthermore, it is not necessary, obviously, that both ends of strip 102 be provided with hook and loop fastener material. Clearly, only one fastener 104, 106 need be provided, the other end of the strip being secured to its respective part by stitching, riveting or the like.

It is to be understood that the present invention is not limited to the embodiments described above, but encompasses any and all embodiments within the scope of the following claims.

I claim:

1. A vapor boot assembly for attachment to a vapor control nozzle assembly having a sealing bellows member, comprising:

a tether element having a first portion for attachment to a body section of a vapor control nozzle assembly, a plate attached to a second portion of said tether element and having a central aperture through which a nozzle of a vapor control nozzle assembly can be inserted, said tether element comprising an inelastic strip of material having a first end and a second end, at least one end of said strip comprising a fastener of hook and loop material, and said tether element defining a distance between said first and second portions selected to retain a sealing bellows member of the vapor nozzle assembly in at least a partially collapsed condition, whereby, with said tether element retaining the sealing bellows member, the partially collapsed sealing bellows member is displaced from the nozzle to allow an operator to view the fluid level in a receptacle, thus to avoid splashing of the fluid as by overfilling the receptacle.

2. A vapor boot assembly for attachment to a vapor control nozzle assembly according to claim 1, wherein said plate has a substantially circular configuration.

3. A vapor boot assembly for attachment to a vapor control nozzle assembly according to claim 1, wherein said plate has a plurality of emission vapor control apertures formed therethrough and positioned proximate to a periphery of said plate.

4. A vapor boot assembly for attachment to a vapor control nozzle assembly according to claim 1, wherein said first end and said second end of said inelastic strip are provided with hook and loop material fasteners.

5. A vapor boot assembly for attachment to a vapor control nozzle assembly according to claim 4, wherein said first D-ring and said plate are connected by an S-hook.

6. A vapor boot assembly for attachment to a vapor control nozzle assembly according to claim 4, wherein said second D-ring and said body section are connected by a snap hook.

7. A vapor boot assembly for attachment to a vapor control nozzle assembly according to claim 4, wherein said first end of said strip is connected to a first D-ring and said second end is connected to a second D-ring.

8. A vapor boot tether assembly in combination with a gasoline nozzle assembly comprising:

a body section attached to a nozzle, said nozzle including a distal nose, an elongated resilient sealing bellows member surrounding said nozzle and provided with a displaceable end face normally biased to a point juxtaposed said distal nose, a tether element having a first portion attached to said body section and a second portion attached to a plate by a S-hook, said plate having a central aperture through which said distal nose of the nozzle can be inserted, said tether element defining a distance between said first and second portions selected to retain said sealing bellows member in at least a partially collapsed condition with said end face displaced away from said distal nose toward said body section, whereby, with said tether element retaining said sealing bellows member, said end face is displaced from said distal nose to allow an operator to view the fluid level in a receptacle to avoid splashing of the fluid as by overfilling the receptacle.

9. The vapor boot tether and gasoline nozzle assembly combination according to claim 8, wherein said plate has a substantially circular shape.

10. The vapor boot tether and gasoline nozzle assembly combination according to claim 9, wherein said plate includes a plurality of apertures formed therethrough and positioned proximate the periphery of said substantially circular plate.

11. The vapor boot tether and gasoline nozzle assembly combination according to claim 8, wherein said first portion of said tether element and said body section are connected by a snap hook.

12. The vapor boot tether and gasoline nozzle assembly combination according to claim 8, wherein said tether element comprises a bungee cord.

* * * * *